US007552881B2

(12) United States Patent
Lipthal et al.

(10) Patent No.: US 7,552,881 B2
(45) Date of Patent: Jun. 30, 2009

(54) SOLID CONE SPRAY NOZZLE

(75) Inventors: Michael Lipthal, Ditzingen (DE); Markus Astfalk, Eningen (DE); Lars Vater, Pliezhausen (DE)

(73) Assignee: Lechler GmbH, Metzingen (DE)

( * ) Notice: Subject to any disclaimer, the term of this patent is extended or adjusted under 35 U.S.C. 154(b) by 0 days.

(21) Appl. No.: 11/524,653

(22) Filed: Sep. 21, 2006

(65) Prior Publication Data

US 2007/0069049 A1 Mar. 29, 2007

(30) Foreign Application Priority Data

Sep. 23, 2005 (DE) ..... 10 2005 047 195

(51) Int. Cl.
*B05B 1/00* (2006.01)

(52) U.S. Cl. ..... 239/597; 239/8; 239/599; 239/590.3; 239/504; 239/524; 239/432; 239/506

(58) Field of Classification Search ..... 239/597, 239/8, 419.3, 419, 504, 524, 590.3, 599, 239/580, 432, 499, 506, 509, 518
See application file for complete search history.

(56) References Cited

U.S. PATENT DOCUMENTS 2,683,627 A * 7/1954 Wahlin ..... 239/597
3,693,886 A * 9/1972 Conrad ..... 239/432
4,128,206 A 12/1978 Bintner
4,330,086 A * 5/1982 Nysted ..... 239/8
4,349,156 A * 9/1982 Haruch et al. ..... 239/432
4,588,131 A * 5/1986 Yamamoto et al. ..... 239/428.5
4,591,099 A * 5/1986 Emory et al. ..... 239/419
4,988,043 A * 1/1991 Lechler ..... 239/597
5,046,668 A * 9/1991 Ikeuchi et al. ..... 239/432
5,133,502 A * 7/1992 Bendig et al. ..... 239/504
5,178,325 A * 1/1993 Nielsen ..... 239/1
5,372,312 A * 12/1994 Vidusek ..... 239/419.3
6,036,116 A * 3/2000 Bui ..... 239/432
6,705,538 B2 * 3/2004 Fecht et al. ..... 239/8

(Continued)

FOREIGN PATENT DOCUMENTS

DE 2 252 218 5/1973

(Continued)

OTHER PUBLICATIONS

German Patent Office Examination Report dated May 23, 2006 (3 pages).

(Continued)

*Primary Examiner*—Dinh Q Nguyen
*Assistant Examiner*—Trevor E McGraw
(74) *Attorney, Agent, or Firm*—Flynn, Thiel, Boutell & Tanis, P.C.

(57) ABSTRACT

The invention relates to a solid cone spray nozzle with a mouthpiece having an outlet chamber and an inlet opening emanating from the outlet chamber and having a smaller cross-section than the latter According to the invention an inlet opening into the outlet chamber has a smaller cross-section than the outlet chamber and downstream of the outlet chamber inlet opening is provided a web-like preatomizer element on which impacts at least partly a fluid jet following entry into the outlet chamber.

Figure 1:
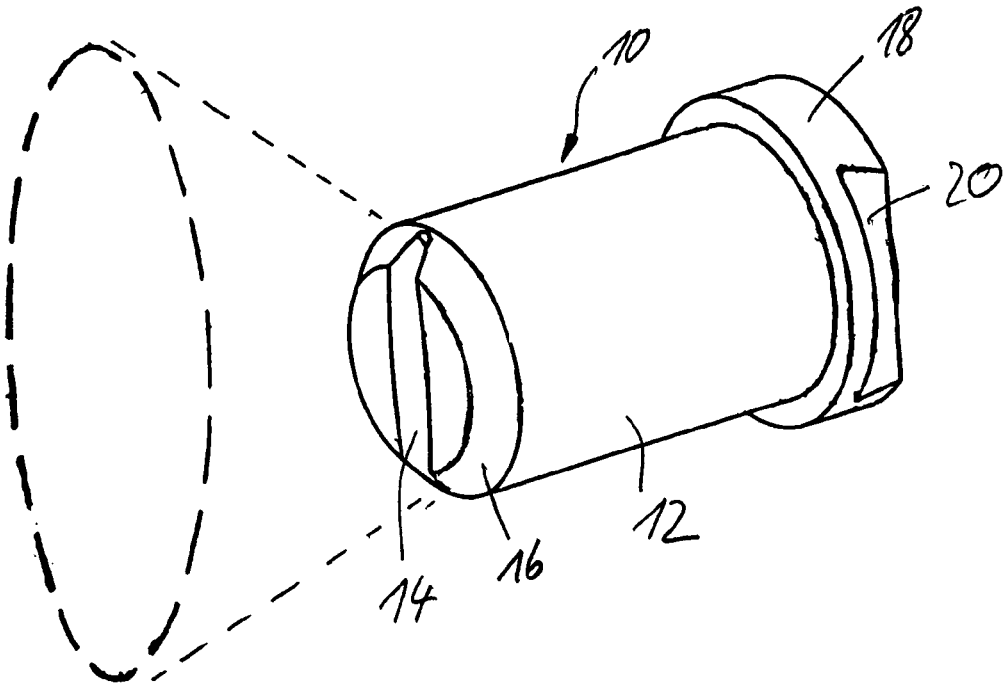

Use e.g. as a two-fluid spray nozzle for spraying or atomizing low viscosity liquids for cooling purposes in billet or bloom continuous casting installations.

20 Claims, 7 Drawing Sheets

U.S. PATENT DOCUMENTS

| | | | | |
|---|---|---|---|---|
| 6,726,127 | B2 * | 4/2004 | Hofherr et al. | 239/432 |
| 2002/0134862 | A1 | 9/2002 | Fecht et al. | |
| 2005/0161525 | A1 * | 7/2005 | Johansson | 239/68 |

FOREIGN PATENT DOCUMENTS

| | | | |
|---|---|---|---|
| DE | 31 31 070 | C2 | 4/1982 |
| DE | 34 29 411 | A1 | 2/1986 |
| EP | 1 047 504 | B1 | 11/2000 |
| EP | 1 243 343 | A1 | 9/2002 |
| WO | WO 99/25481 | | 5/1999 |

OTHER PUBLICATIONS

German Patent Office Examination Report dated Sep. 4, 2006 (2 pages).
European Patent Office Search Report dated Feb. 1, 2008 (7 pages).

* cited by examiner

SOLID CONE SPRAY NOZZLE

The invention relates to a solid cone spray nozzle, particularly for atomizing or spraying low viscosity liquids for cooling purposes in billet or bloom continuous casting installations, having a mouthpiece, an outlet chamber and an outlet opening emanating from the outlet chamber and having a smaller cross-section than the latter.

European patent EP 1243343 B1 discloses a two-fluid solid cone spray nozzle for cooling in continuous casting installations. A mouthpiece of said nozzle has an outlet chamber with an outlet opening emanating from the outlet chamber and having a smaller cross-section of the latter. In the outlet chamber formed by a bore in the mouthpiece is placed a swirl insert with which the gas-liquid mixture is rotated before reaching the outlet opening, so that it can then pass under pressure and in conical form out of the mouthpiece. The swirl insert has several bores or circumferentially positioned milled slots uniformly distributed around the circumference. Upstream of the swirl insert and optionally separated from the mouthpiece by an extension tube is provided a mixing chamber in which a gas flow and a liquid flow vertically strike against one another and are consequently mixed. As a result of the characteristic rotation of the gas-liquid mixture before reaching the outlet opening, it is not possible to obtain in a satisfactory manner shapes other than circular spray cone shapes.

International patent specification WO 99/25481 discloses a slot nozzle for cooling in continuous casting installations. This slot nozzle is intended to give an oval spray cone shape. For this purpose a mouthpiece has an outlet chamber with an outlet opening, which has a smaller cross-section than the outlet chamber, the outlet opening having an oval cross-section. Upstream of the outlet opening the outlet chamber contains a crossbar, which on either side leaves a circular segmental outlet opening, which is symmetrical to the centre of the outlet chamber. Thus, liquid flows only pass through the crossbar on the sides of the outlet chamber. The outlet chamber wall is so shaped in the vicinity of the outlet opening that the liquid flows meet at or directly upstream of the outlet opening in a range between 60 and 130ø. This creates the prerequisites for the impacting of the two liquid flows to give rise to the formation of liquid droplets leaving the outlet opening with a particularly high kinetic energy.

In general, in continuous casting installations and in particular in billet or bloom casting installations there is a need to produce a solid cone spray jet for cooling the continuously cast products, whose shape need not be circular in the case of a uniform liquid distribution because, in the case of billet or bloom continuous casting installations, unlike in the case of slabs with a very flat rectangular cross-section, the continuously cast products have an aspect ratio of 1:1 to approximately 2.5:1. Thus, even shortly after leaving the ingot mould, the continuously cast products are much more stable than slabs which are 0.8 to 3.5 m wide. Thus, in billet or bloom continuous casting installations, the spacing of the guide rollers after leaving the ingot mould can be made larger than in slab continuous casting installations. Due to the larger roller spacing in part more cooling nozzles must be used in order to cool the entire space between two mutually spaced guide rollers. In the case of a given water quantity to be applied, this leads to smaller nozzle cross-sections and therefore to an increased clogging risk. If the gap between two guide rollers is not completely covered by a spray jet, it is possible in the area not covered by said jet for there to be a reheating of the casting shell of the continuously cast product, so that cracks can arise in the said shell. Due to the larger roller spacing it would therefore be desirable to have spray nozzles with an oval spray cone, so that it would be possible to completely cover the surface of the continuously cast product in the gap between two guide rollers with a single spray nozzle and simultaneously to essentially only spray the continuously cast product in the transverse direction of the latter.

The invention aims at providing a solid cone spray nozzle, particularly for spraying or atomizing low viscosity liquids for cooling purposes in billet or bloom continuous casting installations, where there is a homogeneous liquid distribution and low clogging or blockage sensitivity.

For this purpose the invention provides a solid cone spray nozzle, particularly for atomizing low viscosity liquids for cooling bloom or billet continuous casting installations, having a mouthpiece with an outlet chamber and an outlet opening emanating from said outlet chamber and having a smaller cross-section than the latter, in which an inlet opening into the outlet chamber has a smaller cross-section than the latter and in which upstream of the inlet opening in the outlet chamber is provided a web-like preatomizer element which is at least partly struck by the fluid jet after entering the outlet chamber.

With such a nozzle it is possible to produce a solid cone spray jet with a cross-section diverging from a circular shape and in particular having an oval shape, accompanied by a uniform distribution, the web-like preatomizer element on the one hand preventing an entering fluid flow from penetrating through to the outlet opening and on the other ensures a fundamental tearing open of the fluid jet. As there is no longer a characteristic rotation of the fluid jets in the outlet chamber, non-circular cross-sectional shapes of a solid cone jet can be produced with a uniform distribution. This leads to a uniform fluid distribution in the spray cone in the case of a shapable cross-section of said spray cone and at the same time large passage cross-sections are obtained in the spray nozzle so as to ensure a limited clogging risk.

According to a further development of the invention at the transition of the inlet opening into the outlet chamber there is a sudden cross-sectional widening of a flow channel.

Due to such a sudden cross-sectional widening the flow rate is reduced, so that a pressure drop occurs and as a result the boundary conditions are created for tearing open the fluid jet entering the outlet chamber. For example, the inlet opening is provided in a panel and has a radius of 2.5 mm. The outlet chamber can then e.g. have a radius of about 6mm and even with a more limited cross-sectional widening, e.g. a double widening an adequate effect can occur.

According to a further development of the invention a determination of the discharged fluid volume flow takes place by means of the inlet opening cross-section. Thus, a discharged fluid volume flow can be adapted easily by modifying the inlet opening without significantly impairing the spray pattern of the spray nozzle. Advantageously the inlet opening is provided in a panel, so that by replacing the panel a different fluid volume flow can be obtained.

According to a further development of the invention the spray cone is shaped by the outlet opening and optionally by means of an outlet cone connecting onto the outlet opening.

Through the differing shaping of the outlet opening and optionally an outlet cone in the nozzle housing, this makes it possible to obtain the spray cone shapes necessary for a special application. The outlet cone or frustum in the mouthpiece housing can have a random cross-sectional shape which is not circular. Since in the case of the nozzle according to the invention the tearing open and atomizing of an entering fluid jet takes place in the preatomizer and the outlet chamber, the outlet opening shape can be changed without fundamentally modifying a liquid distribution within the spray cone by modifying the outlet opening shape.

According to a further development of the invention the outlet opening has an oval cross-sectional shape and advantageously a widening outlet cone with an oval cross-section is connected to the outlet opening in the outlet direction.

In this way it is possible to obtain a solid cone jet with an oval cross-section particularly advantageous for cooling purposes in billet or bloom continuous casting installations. Unlike in known spray nozzles with an oval spray cone a very regular spray cone shape can be obtained, because also in the marginal areas of the oval spray cone there are no distortions as a result of a significant rotational energy of the spray droplets about a central axis of the nozzle. The term oval or oval shape is understood to mean an elliptical shape, but also an oval shape in the strict sense, i.e. two semicircles linked by straight lines.

According to a further development of the invention the web-like preatomizer element with its longitudinal direction extends substantially perpendicular to an entering fluid jet through the outlet chamber, the longitudinal direction relative to a longer axis of the oval outlet opening being at an angle between 0 and 360ø, particularly 90ø.

It has surprisingly been found that also when providing an oval outlet opening the preatomizer element can be placed at different angular positions with respect to a longitudinal axis of the outlet opening. It has surprisingly been found that it is particularly advantageous to place the web-like preatomizer element at an angle of 90ø to the longer axis of the oval outlet opening.

In a plane perpendicular to the outlet direction, the outlet chamber has an oval cross-section in a further development of the invention.

Such an oval shaping of the outlet chamber can e.g. serve to permit the insertion of the preatomizer element in a single, previously defined position. A longitudinal axis of such an oval outlet chamber can be parallel or also perpendicular to the longitudinal axis of an oval outlet opening.

According to a further development of the invention the inlet opening is located in a panel which is inserted in a mouthpiece housing.

This makes it possible to change the size of the inlet opening by replacing the panel, e.g. in order to match the spray nozzle to the intended use.

According to a further development of the invention the web-like preatomizer element is provided on a U-clip or stirrup, which is inserted in a mouthpiece housing.

In this way, by replacing the stirrup, it is e.g. possible to vary a distance between the preatomizer element and inlet opening, as well as the outlet opening, so as to adapt the nozzle to an intended use.

According to a further development of the invention the panel and stirrup are provided on an integral insert.

In this way the nozzle can be constructed from a few and in particular only two parts, namely the mouthpiece housing with the outlet chamber and the outlet opening and the insert with the panel with the inlet opening and the stirrup with the preatomizer element. It is also possible to ensure a precise spacing between the preatomizer element and the inlet opening.

According to a further development of the invention the preatomizer element is constructed as a web having a rectangular cross-section, a narrow side of the rectangle facing the inlet opening.

The narrow side of the rectangle consequently forms an impact surface for at least part of the fluid jet entering through the inlet opening. If the narrow side is narrower than the inlet opening an entering fluid jet is split into three partial flows. A first partial flow impacts on the preatomizer element and two other partial flows pass through the preatomizer element on the right/left side. The preatomizer element can be of the same width as the inlet opening, so that then there is no subdivision into partial jets and instead the entire entering fluid jet impacts on the preatomizer element.

According to a further development of the invention the web-like preatomizer element is constructed as a round bar or rod extending transversely through the outlet chamber.

This leads to a very simple, but effective construction. By the provision of a bore in the mouthpiece housing, a rod can be inserted and fixed in the same.

According to a further development of the invention an impact surface of the web-like preatomizer element facing the inlet opening is curved outwards towards the latter, planar or constructed in the form of an inner face of a depression in the preatomizer element.

This makes it possible to influence the tearing open of the entering fluid jet at the preatomizer element. The depression can have a conical or spherical shape.

According to a further development of the invention the outlet opening is located in an outlet chamber bottom, the inner walls of the outlet chamber meeting in an imaginary centre of the outlet opening at an angle between 140 and 180ø, particularly between 170 and 180ø.

Such a chamber bottom construction contributes to a uniform fluid distribution in the spray jet and to a shapability of the spray jet cross-section by modifying the outlet opening shape.

The chamber bottom can be spherical or planar and the outlet chamber side walls can be perpendicular to the planar chamber bottom or at an angle of less than 90ø on said planar chamber bottom. The side walls can in a sectional view be curved or straight.

According to a further development of the invention the chamber bottom is formed by a displacement of a milling or drilling tool, particularly a ball end drill in at least one lateral direction.

This e.g. makes it possible to obtain an oval outlet chamber cross-section.

According to a further development of the invention a mixing chamber for liquid and gas is provided upstream of the inlet chamber.

In this way the solid cone spray nozzle according to the invention can be used as a two-fluid nozzle, e.g. for spraying an air/water mixture. For an entry of a liquid flow, the mixing chamber can be constructed perpendicular to a gas flow the flow direction from the mixing chamber to the mouthpiece being substantially perpendicular to the liquid flow entry direction into the mixing chamber.

This leads to a uniform mixing of the gas flow and the liquid flow.

According to a further development of the invention an extension tube is located between the mixing chamber and mouthpiece.

Thus, the mouthpiece of the solid cone spray nozzle according to the invention can be moved close to the location to be subject to the action of the spray jet even with constricted space conditions, e.g. in continuous casting installations.

Further features and advantages of the invention can be gathered from the following description in conjunction with the drawings. The drawings show different embodiments of the invention with in each case different individual features. Within the scope of the invention individual features from different embodiments can be combined without leaving the scope of the invention. In the drawings show:

FIG. 1 A perspective view of an inventive soli cone spray nozzle with an oval spray cone.

Figure 2:
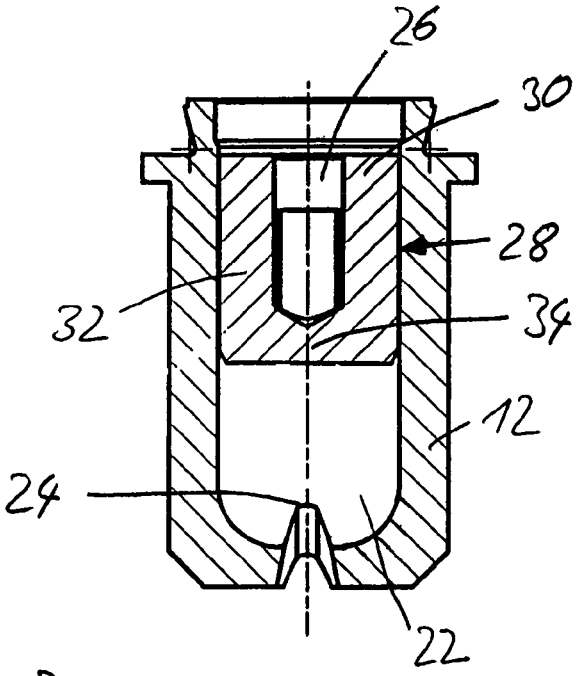

FIG. 2 A sectional view of the spray nozzle of FIG. 1.

Figure 3:
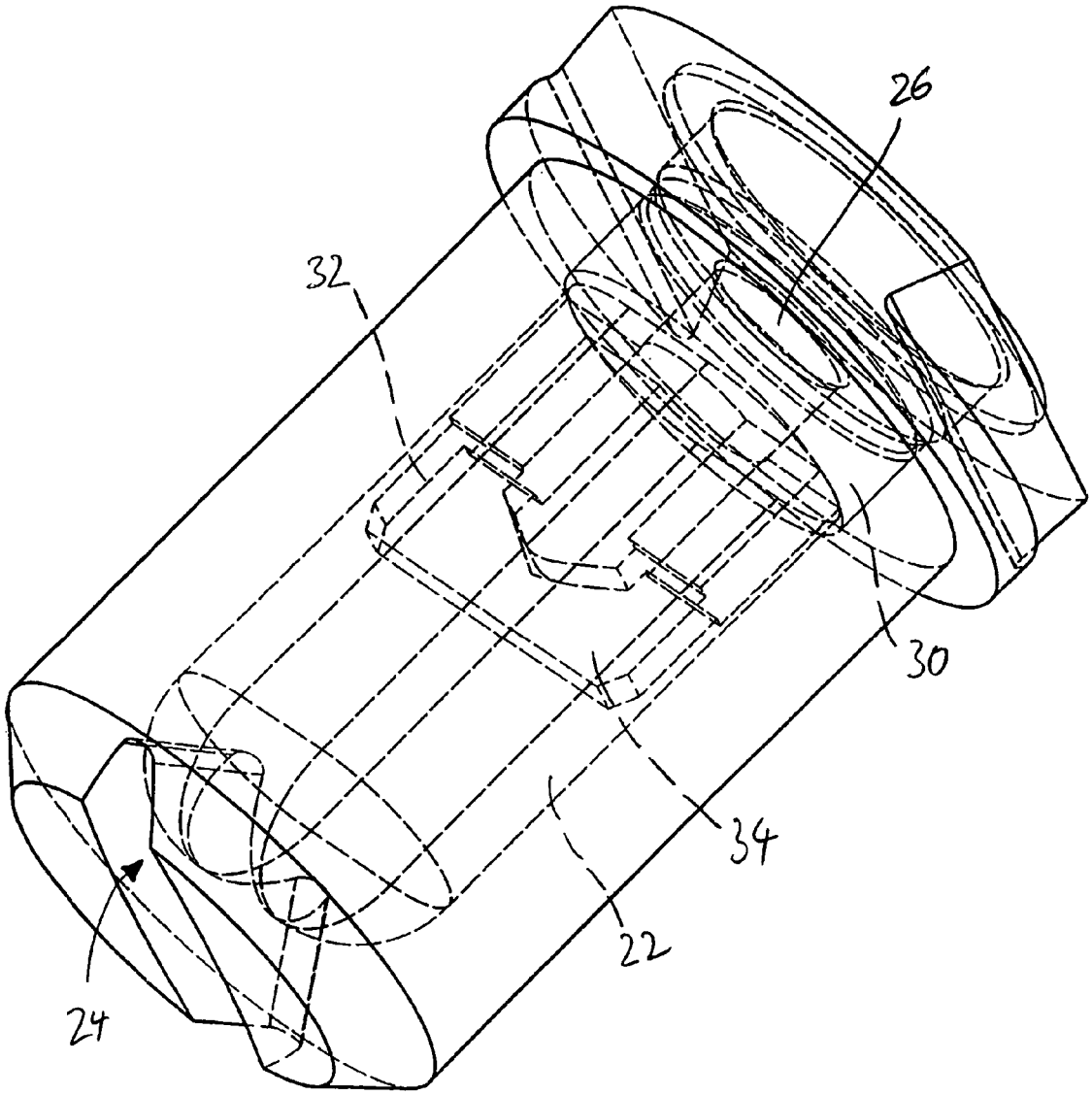

FIG. 3 Another perspective view of the spray nozzle of FIG. 1, in which components thereof not visible in FIG. 3 are indicated in broken line form.

Figure 4:
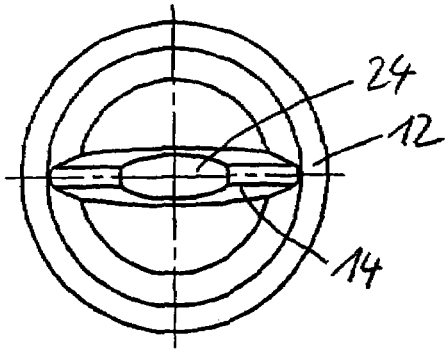

FIG. 4 A plan view of the side of the spray nozzle of FIG. 1 with the outlet opening.

Figure 5:
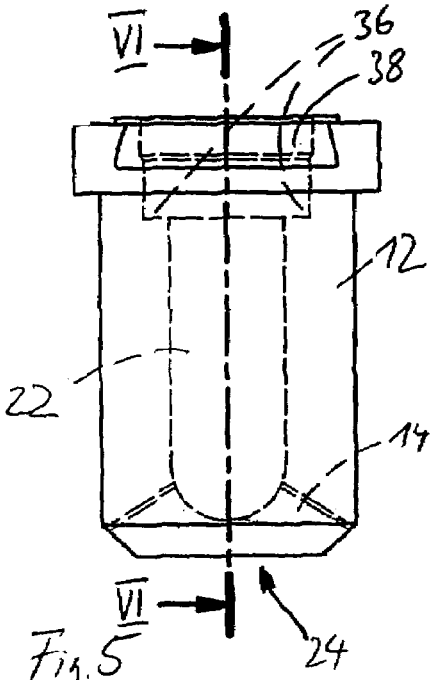

FIG. 5 A side view of the mouthpiece of the spray nozzle of FIG. 1.

Figure 6:
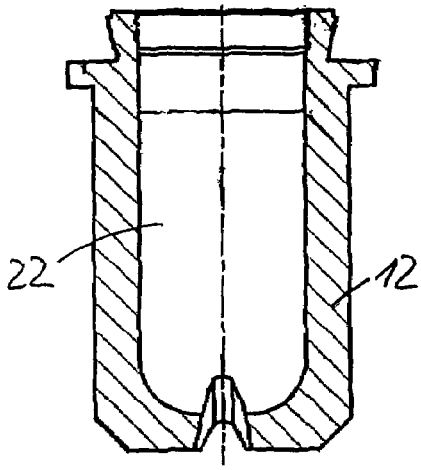

FIG. 6 A sectional view along line VI-VI in FIG. 5.

Figure 7:
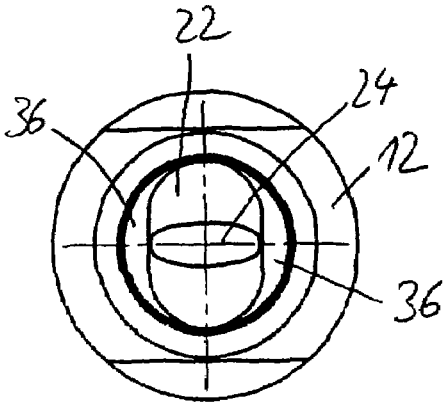

FIG. 7 A plan view of the mouthpiece of the spray nozzle of FIG. 1 from the side opposite to the outlet opening.

Figure 8:
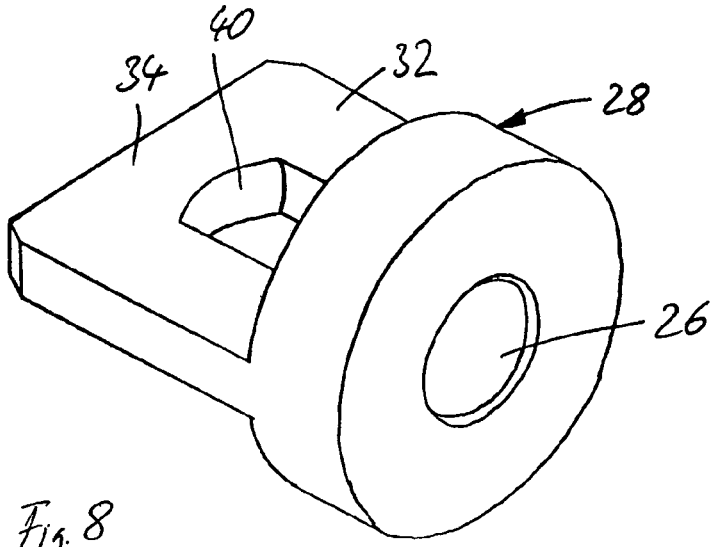

FIG. 8 A perspective view of the insert with the preatomizer element of the spray nozzle of FIG. 2.

Figure 9:
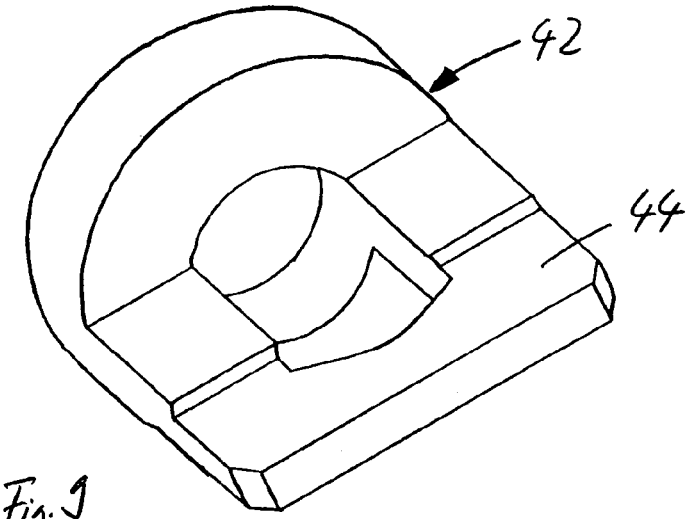

FIG. 9 Another embodiment of an insert.

Figure 10:
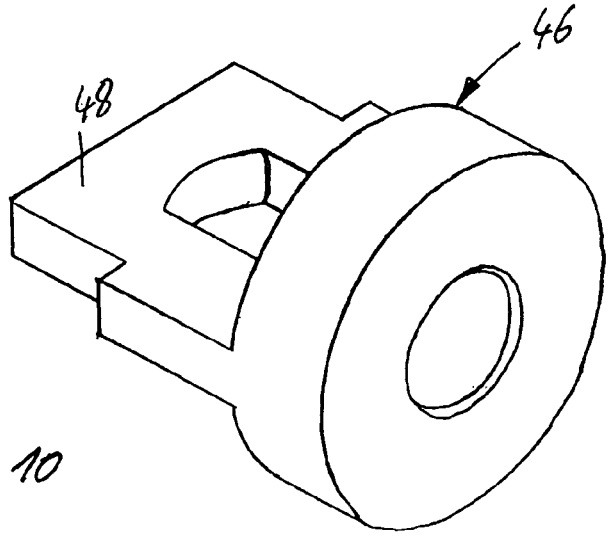

FIG. 10 Another embodiment of an insert.

Figure 11:
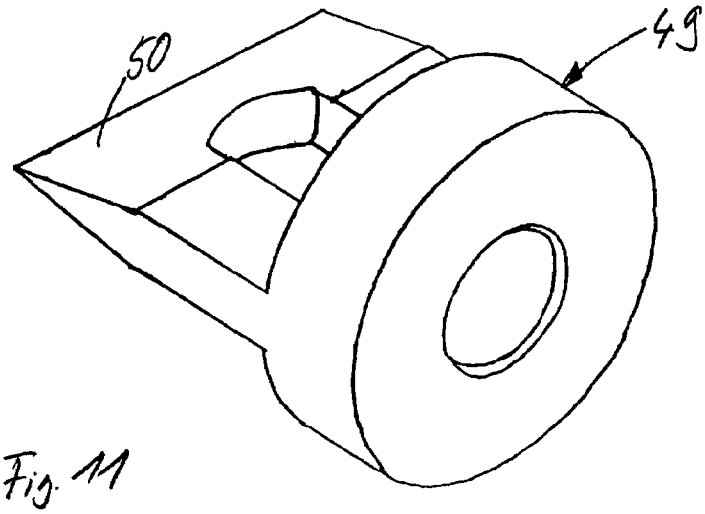

FIG. 11 Another embodiment of an insert.

Figure 12:
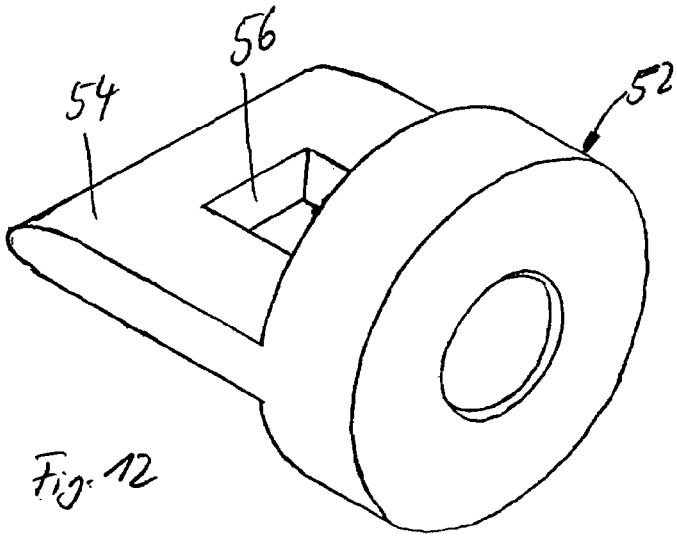

FIG. 12 Another embodiment of an insert.

Figure 13:
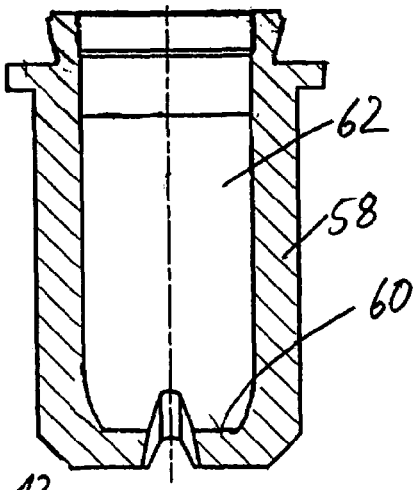

FIG. 13 An alternative embodiment of a mouthpiece for an inventive spray nozzle.

Figure 14:
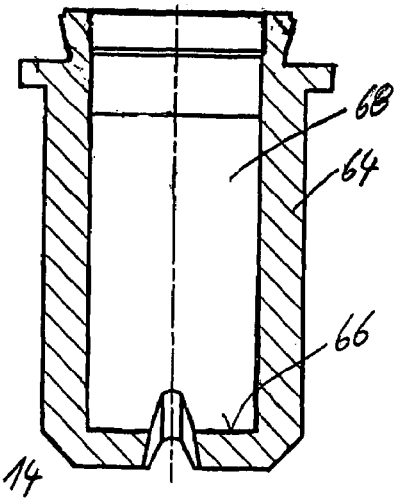

FIG. 14 Another alternative embodiment of a mouthpiece for an inventive spray nozzle.

Figure 15:
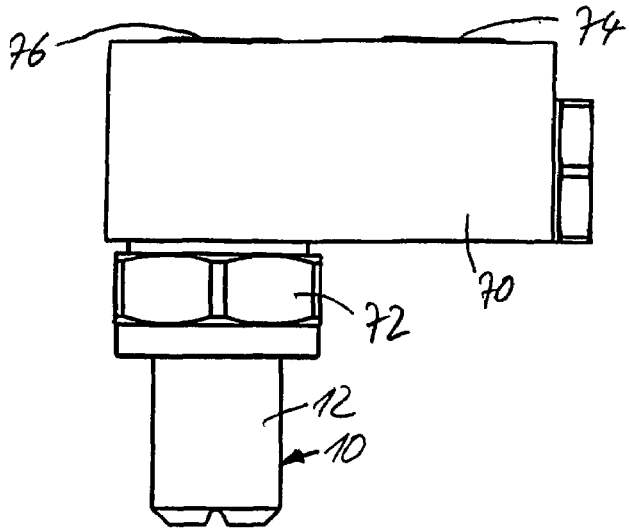

FIG. 15 A side view of the spray nozzle of FIG. 1 in conjunction with a mixing chamber.

Figure 16:
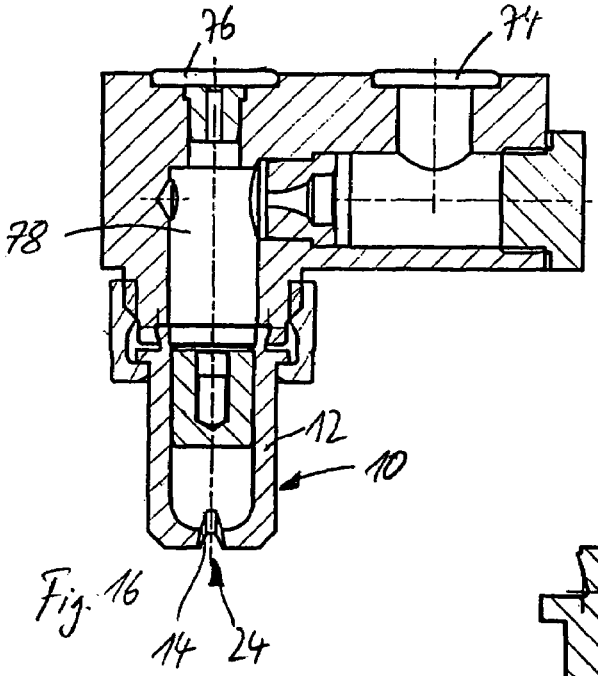

FIG. 16 A sectional view of the arrangement of FIG. 15.

Figure 17:
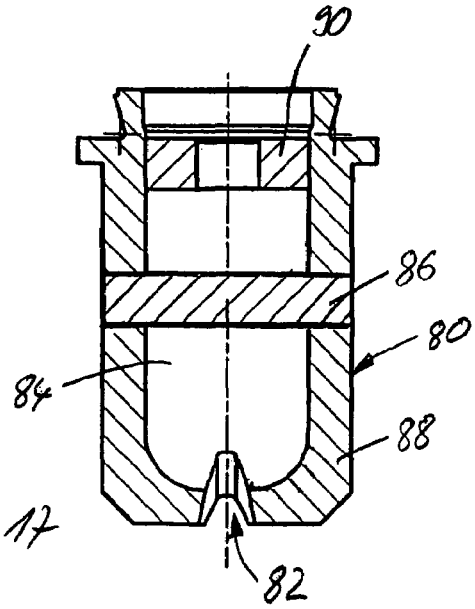

FIG. 17 A sectional view of an alternative embodiment of an inventive spray nozzle.

Figure 18:
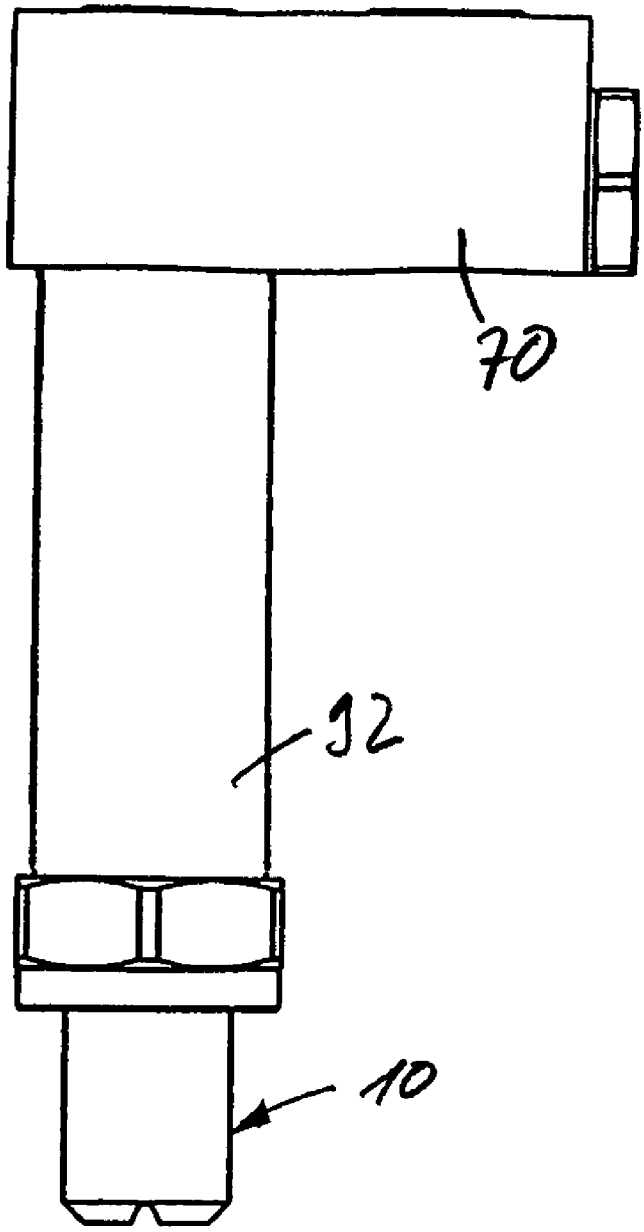

FIG. 18 A side view of an inventive spray nozzle with mixing chamber and extension tube.

The perspective view of FIG. 1 shows an inventive spray nozzle 10 with an integral mouthpiece housing 12. In an end face of mouthpiece housing 12 it is possible to see an outlet cone 14, which is connected to an oval outlet opening not visible in FIG. 1. Outlet cone 14 also has an oval crosssectional shape, although this is not readily apparent in the view of FIG. 1 and also the lateral ends of the outlet cone are cut off by the chamfer 16 provided at the transition of the end face to the lateral face of mouthpiece housing 12.

Mouthpiece housing 12 has a generally cylindrical shape and is provided at its rear end for connection to a fluid supply line with a circumferential flange 18. Flange 18 is laterally provided with flattenings 20, but in the view of FIG. 1 only one flattening can be seen, the facing, identical flattening being invisible.

FIG. 1 shows in broken line form a spray cone produced by spray nozzle 10 and which has a uniform, oval shape.

The sectional view of FIG. 2 shows the mouthpiece housing 12 and the outlet chamber 22 formed by the bore in the latter. An oval or elliptical outlet opening 24 is located at a front end of outlet chamber 22 and passes into the outlet cone 14. An inlet opening 26 is provided at the end of outlet chamber 22 opposite to outlet opening 24. Inlet opening 26 has a circular cross-section and is implemented by means of a bore in an insert 28 inserted in outlet chamber 22.

Insert 28 has a circular panel 30 in which is provided the inlet opening 26, as well as a U-clip or stirrup 32 emanating from the circular panel 30 and extending in the direction of outlet opening 24 into outlet chamber 22.

A crossbar 34 is provided on insert 28 opposite to inlet opening 26. Crossbar 34 forms a preatomizer element on which impacts a fluid jet entering through inlet opening 26.

The perspective view of FIG. 3 also shows the spray nozzle 10 of FIG. 1 and parts which are not visible are shown in broken line form. FIG. 3 shows that the stirrup 32 of insert 28 has a limited thickness, so that, considered in the entry direction, on either side of stirrup 32 areas of outlet chamber 22 are free and a fluid flow can spread therein. A fluid jet entering through the circular inlet opening 26 consequently impacts on crossbar 34 and is therefore split into three partial flows. A first partial flow is torn open by impacting on crossbar 34. A second and third partial flow passes respectively to the right and left of crossbar 34 and into outlet chamber 22. As stirrup 32 only takes up a small part of the cross-section of outlet chamber 22, at the outlet from panel 30 there is a sudden cross-sectional widening, so that a fluid jet entering through inlet opening 26 is subject to a considerable pressure drop and is consequently torn open. The fluid jet parts moving past crossbar 34 are also torn open and a uniform spray pattern of spray nozzle 10 can be obtained.

FIG. 3 also shows the shape of outlet chamber 22, which arises through a lateral displacement of a ball end drill. A bottom of outlet chamber 22 surrounding outlet opening 24 is consequently built up from two quadrant surface segments and a semicylindrical surface segment placed between the same. At an imaginary centre point of outlet opening 24 the side walls of outlet chamber 22 meet one another at an angle of 0ø. The atomizing effect in the case of the nozzle according to the invention is not obtained through the impacting of the liquid jets in the vicinity of the outlet opening, but instead atomization of the entering fluid jets already occurs after passing through panel 30 or on impacting on the preatomizer element crossbar 34. In the case of the nozzle according to the invention, the chamber bottom design is consequently of minor significance for the function of the nozzle, but obviously the chamber bottom design can influence the liquid distribution within the spray cone produced.

The view of FIG. 4 shows the mouthpiece opening 12 of the spray nozzle of FIG. 1 from the side of outlet opening 24. It is easily possible to see in this view the oval or elliptical shape of outlet opening 24. FIG. 4 also readily shows the oval cross-sectional shape of outlet cone 14 widening outwards away from outlet opening 24. Outlet cone 14 and outlet opening 24 can e.g. be formed by cutting in mouthpiece housing 12 using a suitable milling tool.

The cylindrical outer shape of mouthpiece housing 12 can be gathered from the side view of FIG. 5. FIG. 5 shows in broken line form outlet chamber 22 which is not visible. In the view of FIG. 5 the narrow side of outlet chamber 22 faces the viewer. Outlet opening 24 and outlet cone 14 have their wide side facing the viewer in FIG. 5. Thus, the longitudinal axis of the oval cross-section of outlet chamber 22 and the longitudinal axis of the oval or elliptical outlet opening 24 and outlet cone 14 are arranged perpendicular to one another.

FIG. 5 also shows in broken line form two facing steps or shoulders 36 at the end of outlet chamber 22 opposite to outlet opening 24. These shoulders 36 arise through the transition from the circular inlet bore 38 in mouthpiece housing 12 to the oval cross-section of outlet chamber 22 Shoulder 36 serves as a bearing surface for insert 28 shown in FIG. 2 and specifically for the circular panel 30 of insert 28.

The sectional view of FIG. 6 is a section along line VI-VI in FIG. 5. In this view the wider side of outlet chamber 22 faces the viewer. As a result, in the view of FIG. 6, the side walls of outlet chamber 22 pass flush into the side walls of inlet bore 38. Insert 28 shown in FIG. 2 consequently rests on the shoulders 36 only over part of its circumference.

The view of FIG. 7 shows the mouthpiece housing 12 from the side of inlet bore 38. It is readily possible to see the crescent-shaped shoulders 36 for fixing insert 28. It is also possible to see the arrangement of the cross-sectionally oval outlet chamber 22 with its longer axis perpendicular to the longer axis of the oval or elliptical outlet opening 24. FIGS. 2 and 7 show that the insert 28 is inserted in outlet chamber 22 in such a way that panel 30 rests on shoulders 36 and the crossbar 34 then extends parallel to the longer axis of outlet chamber 22 and therefore perpendicular to the longer axis of outlet opening 24. Due to the oval cross-section of outlet chamber 22, insert 28 can only be inserted in two positions, turned by 180ø, into the mouthpiece housing 12.

The perspective view of FIG. 8 shows insert 28 of FIG. 2 in greater detail. It can be seen that insert 28 is built up in one piece, e.g. from a sectionally bilaterally milled cylinder. A bore parallel to the longitudinal axis of said cylinder forms the inlet opening 26 and gives rise to stirrup 32 and crossbar 34. The machining processes can obviously take place conversely, so that firstly the bore is made and then the cylinder segments are milled. It can be seen in FIG. 8 that use is made of a drill with a conical tip or point, so that an impact surface 40 forming the lateral face of crossbar 34 facing inlet opening 26 has. a conical segmental depression. This depression in the impact surface 40 serves to control the tearing open of the partial jet impacting on crossbar 34. It is e.g. alternatively possible to have a spherical segmental depression, a planar impact surface or an impact surface curved outwards towards the inlet opening 26.

Insert 28 of FIG. 8 ensures a precise spacing between impact surface 40 of crossbar 34 and inlet opening 26. As insert 28 is only inserted in mouthpiece housing 12, the spray behaviour of the nozzle can be modified by simply changing insert 28.

The perspective view of FIG. 9 shows an insert 42 according to an alternative embodiment. Insert 42 has a crossbar 44 with a smaller thickness than the remaining stirrup. As a result there is a reduction in the size of the impact surface encountered by a fluid jet entering through the panel and cross-sectionally larger partial jets pass the crossbar 44 on both sides. In this way it is possible to influence the spray pattern of the spray nozzle according to the invention.

Another alternative embodiment is shown in the perspective view of FIG. 10. Insert 46 here has a stirrup, which has a reduced width in the vicinity of the crossbar, so that between the right and left-hand ends of crossbar 48 and the inner wall of the outlet chamber there is always a gap. This also makes it possible to influence the spray pattern of the inventive spray nozzle.

The perspective view of FIG. 11 shows a further development of an insert 48, where the thickness of crossbar 50 decreases in the direction away from the inlet opening, so that a knife edge-like crossbar 50 is obtained.

The perspective view of FIG. 12 shows another embodiment of an insert 52. Here a crossbar 54 is rounded on its side remote from the inlet opening in the panel and the impact surface 56 facing the inlet opening is rectangular and planar.

The sectional view of FIG. 13 shows a possible alternative embodiment of a mouthpiece housing 58. A chamber bottom 60 is planar in this case and the side walls of an outlet chamber 62 pass at an angle of less than 90ø towards the planar chamber bottom 60. The mouthpiece housing 58 can e.g. be made by a lateral displacement of an offset drill, i.e. a drill with curved lateral faces tapering to a point.

The sectional view of FIG. 14 shows another embodiment of a mouthpiece housing 64. A chamber bottom 66 is planar and the side walls of an outlet chamber 68 run at right angles towards the planar chamber bottom 66.

In the side view of FIG. 15 the spray nozzle 10 of FIG. 1 is fixed to a mixing chamber housing 70. The mouthpiece housing 12 is fixed by a box nut 72 to an external thread of mixing chamber housing 70. Mixing chamber housing 70 has a first inlet 74 for liquid, e.g. water and a second inlet 76 for gas, e.g. compressed air. As can be seen in the sectional view of FIG. 16, a water jet is introduced transversely to a longitudinal axis of a mixing chamber 78 and a conical impact surface is provided on the side of mixing chamber 38 opposite to the inlet nozzle. Through the connection 76 compressed air is introduced at a right angle to the liquid jet into mixing chamber 78, so that in the latter there is an intimate mixing between gas and liquid and so as to enter the mouthpiece housing 12 as a fluid mixture. As has already been explained, the fluid mixture then passes the inlet opening into the insert panel and part of the fluid jet impacts on the crossbar of the insert. Due to the sudden cross-sectional widening at the transition from the panel into the outlet chamber the entering fluid jet is torn open. The turbulent fluid finally passes out of outlet opening 24. Thus, in the embodiment of FIGS. 15 and 16, the inventive spray nozzle 20 is operated as a two-fluid spray nozzle, but is in the same way suitable as a single-fluid spray nozzle.

In the case of the inventive spray nozzle 10, a fluid volume flow through outlet opening 24 is determined by the size of the inlet opening in the insert panel. Outlet opening 24 and the outlet cone 14 connecting onto outlet opening 24 are then responsible for the shaping of the spray cone. Thus, the spray nozzle according to the invention can be manufactured with different shapes for the outlet openings and outlet cones, so that the spray cone shape required for a given application can be obtained. As the discharged fluid volume flow is determined by the inlet opening in the panel, such an outlet opening shape adaptation does not lead to a change in the discharged fluid volume flow. Conversely the discharged fluid volume flow can be adapted by modifying the panel, without significantly modifying the shape of the discharged spray cone.

It is also pointed out that the inventive spray nozzle 10 has large passage cross-sections and is consequently little sensitive to clogging. The solid spray cone with an oval cross-section produced by spray nozzle 10 is produced by a single outlet opening 24 and the panel also has a single, cross-sectionally large inlet opening.

The sectional view of FIG. 17 shows another embodiment of an inventive spray nozzle 80, which has an oval outlet opening 82 and an outlet chamber 84 with oval cross-section. A longer axis of the oval outlet chamber 84 is positioned perpendicular to a longer axis of oval outlet opening 82. A rod 86 is located in outlet chamber 84 perpendicular to the longer axis of outlet opening 82. Rod 86 serves as a preatomizer element and is inserted in a bore traversing the mouthpiece housing 88. In the end of outlet chamber 84 opposite to outlet opening 82 is inserted a circular panel 90 with a central inlet opening. A fluid jet passes through inlet opening 92 and impacts on rod 86. Through the impact and the sudden cross-sectional widening at the transition from panel 90 into outlet chamber 84, the entering fluid jet is torn open, so that after passing out of outlet opening 82 a solid spray cone with an oval cross-sectional shape can be produced.

The spray nozzle 80 is also not very sensitive to clogging and is easy to manufacture, because rod 86 and panel 90 can be manufactured as simple turned parts.

The view of FIG. 18 shows the spray nozzle 10 of FIG. 15 upstream of which is connected the mixing chamber housing 70 of FIG. 15. An extension tube 92 is positioned between mixing chamber housing 70 and spray nozzle 10. By means of extension tube 92, under spatially constricted conditions, the spray nozzle can be positioned close to the intended spraying point, e.g. between the guide rollers of a continuous casting installation.

The invention claimed is:

1. Solid cone spray nozzle, for atomizing low viscosity liquids for cooling purposes in billet or bloom continuous casting installations, comprising: a mouthpiece with an outlet chamber and an outlet opening emanating from said outlet chamber, said outlet opening having a smaller cross-section than the said outlet chamber, wherein an inlet opening in said outlet chamber has a smaller cross-section than said outlet chamber and downstream of the inlet opening in said outlet chamber is provided a web-like preatomizer element in the form of a crossbar impacted by a small portion of a fluid jet entering said outlet chamber, the remainder of the fluid jet passing by the crossbar undiverted, wherein said crossbar laterally divides a cross section of said outlet chamber at a height of said crossbar into two halves defined on either side of a longitudinal axis of said outlet chamber, the inlet opening is provided in a panel inserted in a mouthpiece housing, the web-like preatomizer element is provided on a stirrup inserted in the mouthpiece housing, and the panel and stirrup are provided on an integral insert.

2. Solid cone spray nozzle according to claim 1, wherein the fluid volume discharged is determined by means of the cross-section of said inlet opening.

3. Solid cone spray nozzle according to claim 1, wherein there is a shaping of the spray cone by means of said outlet opening.

4. Solid cone spray nozzle according to claim 1, wherein the outlet opening has an oval cross-sectional shape.

5. Solid cone spray nozzle according to claim 4, wherein a widening outlet cone with oval cross-section connects onto said outlet opening in the outlet direction.

6. Solid cone spray nozzle according to claim 4, wherein the web-like preatomizer element has its longitudinal direction extending substantially perpendicular to an entering fluid jet through the outlet chamber, the longitudinal direction being at an angle of 90ø to a longer axis of the oval outlet opening.

7. Solid cone spray nozzle according to claim 1, wherein the outlet chamber has an oval cross-section in a plane perpendicular to the outlet direction.

8. Solid cone spray nozzle according to claim 1, the web-like preatomizer element is constructed as a web with a rectangular cross-section, a narrow side of the rectangular cross-section facing the inlet opening.

9. Solid cone spray nozzle according to claim 1, wherein the web-like preatomizer element is constructed as a rod extending transversely through said outlet chamber.

10. Solid cone spray nozzle according to claim 1, wherein an impact surface of the web-like preatomizer element facing the inlet opening is outwardly curved towards the latter, planar or constructed as an inner face of a depression in the preatomizer element.

11. Solid cone spray nozzle according to claim 1, wherein the outlet opening is located in an outlet chamber bottom, the inner walls of the outlet chamber in an imaginary centre of outlet opening meet an angle between 140ø and 180ø.

12. Solid cone spray nozzle according to claim 1, wherein the chamber bottom is spherical.

13. Solid cone spray nozzle according to claim 1, wherein the chamber bottom is planar.

14. Solid cone spray nozzle according to claim 13, wherein the inner walls of outlet chamber are perpendicular to the planar chamber bottom.

15. Solid cone spray nozzle according to claim 13, wherein the inner walls of outlet chamber taper towards the planar chamber bottom at an angle of less than 90ø.

16. Solid cone spray nozzle according to claim 1, wherein the chamber bottom is formed by the displacement of a milling or drilling tool, particularly a ball end drill, in at least one lateral direction.

17. Solid cone spray nozzle according to claim 1, wherein a mixing chamber for liquid and gas is provided upstream of inlet opening.

18. Solid cone spray nozzle according to claim 17, wherein mixing chamber is constructed for the entry of a liquid flow perpendicular to a gas flow, a flow direction from mixing chamber to the mouthpiece being substantially perpendicular to the entry direction of the liquid flow into mixing chamber.

19. Solid cone spray nozzle according to claim 17, wherein an extension tube is provided between mixing chamber and the mouthpiece.

20. Solid cone spray nozzle according to claim 1, wherein there is a shaping of the spray cone by means of an outlet cone (14) connecting onto said outlet opening.

* * * * *